United States Patent [19]

Bakermans et al.

[11] Patent Number: 4,461,522

[45] Date of Patent: Jul. 24, 1984

[54] ZERO INSERTION FORCE CONNECTOR FOR A CIRCUIT BOARD

[75] Inventors: Johannes C. W. Bakermans, Harrisburg, Pa.; Dimitry G. Grabbe, Lisbon Falls, Me.; Iosif Korsunsky, Harrisburg, Pa.

[73] Assignee: AMP Incorporated, Harrisburg, Pa.

[21] Appl. No.: 410,236

[22] Filed: Aug. 23, 1982

[51] Int. Cl.[3] ..... H01R 9/09

[52] U.S. Cl. ..... 339/17 M; 339/75 MP; 339/176 MP

[58] Field of Search ..... 339/17 M, 75 MP, 74 R, 339/176 MP

[56] References Cited

U.S. PATENT DOCUMENTS

| | | | |
|---|---|---|---|
| 3,920,302 | 11/1975 | Cutchaw | 339/75 MP |
| 3,940,786 | 2/1976 | Scheingold et al. | 357/74 |
| 4,077,688 | 3/1978 | Cobaugh et al. | 339/74 R |
| 4,159,154 | 6/1979 | Arnold | 339/75 MP |
| 4,186,982 | 2/1980 | Cobaugh et al. | 339/17 C |
| 4,386,815 | 6/1983 | Carter et al. | 339/17 M |
| 4,392,700 | 7/1983 | Showman et al. | 339/17 M |

FOREIGN PATENT DOCUMENTS

| | | | |
|---|---|---|---|
| 2423266 | 12/1974 | Fed. Rep. of Germany | 339/75 MP |
| 2252670 | 6/1975 | France | 339/75 MP |
| 1187949 | 4/1970 | United Kingdom | 339/176 MP |

*Primary Examiner*—John McQuade

*Attorney, Agent, or Firm*—Donald M. Boles

[57] ABSTRACT

A miniature circuit board edge connector having a very short electrical contact path is taught. Briefly stated, an insulative housing has contained therein a resiliently flexible and electrically conductive contact. A camming device is disposed in the housing and impinges upon the contact and through lateral motion of the cam, urges the contact vertically downward so as to cause downward and outward movement of a portion of the contact with respect to the housing which thereby comes in contact with an electrically conductive path on a daughter board which is adjacent thereto. A portion of the contact is in slidable electrical communication with a conductive post which is mounted in the base of the connector assembly and attached to a mother circuit board. The electrical path between the daughter board circuit board and the mother board conductive post through the contact is very short and in a slightly arcuate manner and minimizes inductive, capacitive and propagation delay effects.

8 Claims, 6 Drawing Figures

ZERO INSERTION FORCE CONNECTOR FOR A CIRCUIT BOARD

This invention relates, generally, to a circuit board edge connector assembly and more particularly to a zero insertion force connector assembly suitable for use with semi-conductors exhibiting very high switching speeds.

While zero insertion force connectors are relatively common, they generally have a tendency to utilize complex arrangements and complicated manufacturing procedures to accomplish such a purpose. Additionally, contact length between mother and daughter board has a tendency to become unnecessarily long thereby incurring inductive, capacitive as well as propagation delay time problems into a circuit. This problem is particularly acute when connectors are used with newer generation semi-conductors which have an extremely high switching speed. These switching speeds may be in the giga-hertz range and utilize very low switching energy and can have a signal swing as low as approximately 400 millivolts. Therefore, a reflection approaching 30% of that may make it impossible for a system to operate with the required reliability. Further, and as was mentioned earlier, propagation delay times due to contact length, can become a significant problem when a multitude of connectors are utilized given the modularity and plug in utilization capabilities of state of the art semi-conductor devices. One such device is U.S. Pat. No. 4,077,688 "Zero Force Connector For Circuit Boards" issued Mar. 7, 1978 to Cobaugh et al, and which teaches the use of a zero insertion force connector having relatively few components but which utilizes a contact length which could be considered long for high speed switching device purposes.

The assembly of the present invention solves this problem by incorporating electrical contacts having very short contact lengths and utilizes a cam which resiliently flexes the contacts toward and against contact strips contained on the daughter board and slidably contacting contacts which are contained in the housing and in turn connected to the circuit conductors contained on the mother board. This thereby establishing electrical contact between the mother board and the main board.

It is therefore an object of this invention to provide a zero force insertion connector for a circuit board having small dimensions and a very short electrical contact path.

It is another object of the present invention to provide a connector assembly which is relatively simple to manufacture and assemble having a minimum number of individual parts or components.

It is still another object of the present invention to provide a connector assembly which in conjunction with utilizing very short circuit paths provides a contact wiping action, automatic compensation to match the coefficient of expansion of the mother and daughter circuit board material, insertion of the daughter board from either the side or the top, requiring no tools to operate while having replaceable contacts that are fully retracted during insertion or extraction of the daughter circuit board.

Accordingly, the present invention teaches and as an object of the present invention, a circuit board edge connector having an insulative housing, a conductive post projecting from the housing, a circuit board having conductive strips contained thereon with the circuit board being receivably received by the housing, an electrically conductive spring contact disposed in the housing having a portion thereof in slidable electrical communication with the conductive post and further being resiliently deformable so as to come into or out of electrical contact with the conductive strips when the spring contact is urged upward or allowed to retract downward by a camming device and a camming device disposed in the housing, and impinging upon the contact so as to cause movement of the contact when the cam experiences movement.

BRIEF DESCRIPTION OF THE DRAWINGS

Reference is now made to the description of the preferred embodiment illustrated in the accompanying drawings in which:

FIG. 3 is another side sectional view similar to that of FIG. 2 with the contacts in the closed position;

DESCRIPTION OF THE PREFERRED EMBODIMENT

Figure 1:
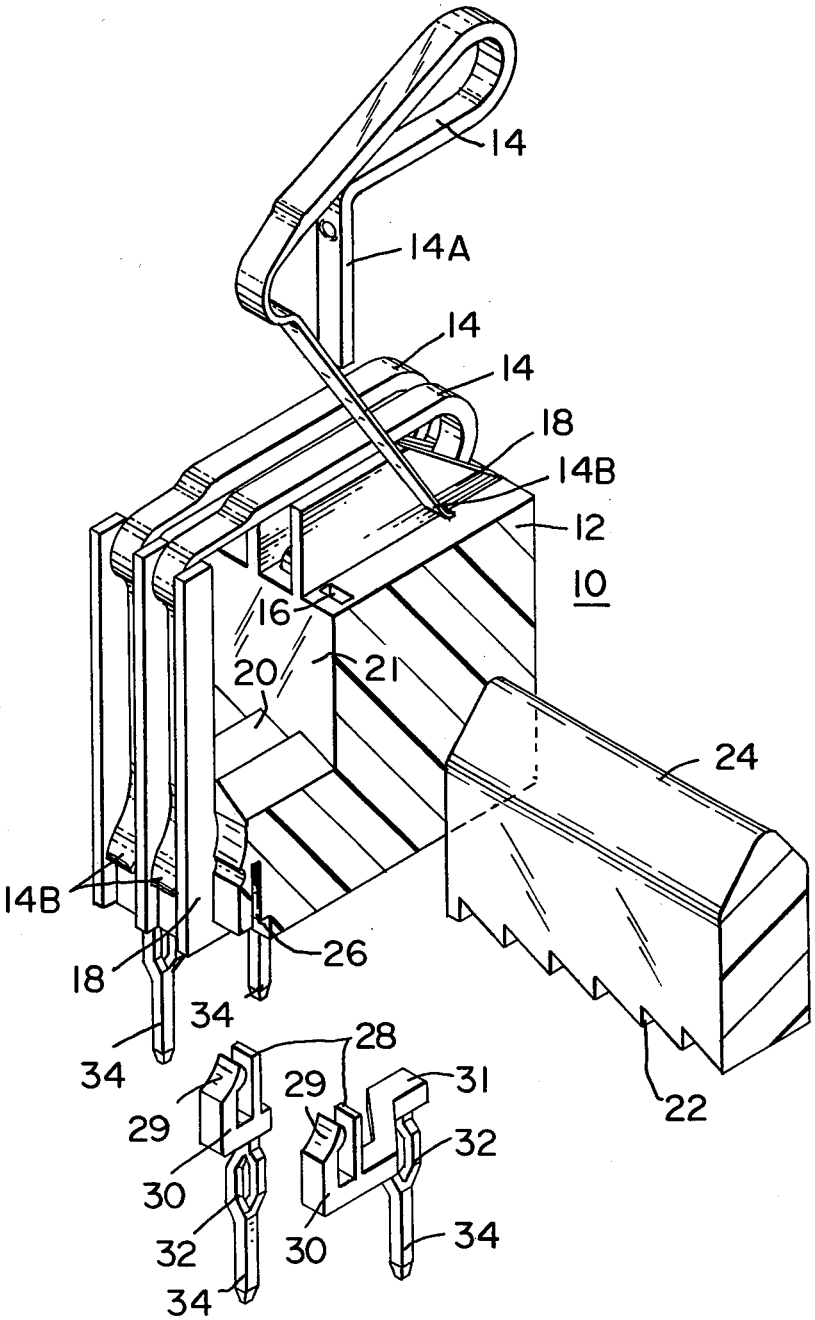
FIG. 1 is an enlarged perspective view of the electrical connector assembly of the present invention.

Referring now to FIG. 1 there is shown an enlarged perspective view of a connector assembly of the present invention. The connector assembly 10 comprises a housing 12 which is made up of an insulative material, such as, for example, plastic. Disposed in the housing 12 is a contact 14. The contact 14 has a contact retaining portion **14*a* and the contact tip 14*b*. The contact retaining portion 14*a* is fitted into the contact retainer slot 16 disposed in the housing 12. This therefore helps to rigidly fix the contact 14 to the housing 12. Disposed between each contact 14 are contact barriers 18 which provide electrical isolation between each contact 14 as well as ameliorate problems associated with undesirable twisting or deformation of the contact 14**.

Housing cam serrations 20 are disposed in the housing 12 and are used to interact with cam serrations 22 which are disposed on the cam 24. The cam 24 is inserted adjacent to the housing serrations 20 in a lateral motion so as to impinge upon the contacts 14 (shown more clearly in FIGS. 2 and 3).

A conductive post retaining slot 26 is disposed in the housing 12 so as to receive and rigidly retain the conductive post retaining tabs 28. In order to effectuate compactness of the connector assembly 10, the conductive post contact 30 is staggered or offset from the offset conductive post contact 31. This therefore allows the contact areas 29 to be lined up with each other in the housing 12 while allowing the conductive posts 34 to form a zig-zag configuration (shown more clearly in FIGS. 2 and 3). Disposed on the conductive posts 34 is a split portion 32 which is used to mount the connector assembly 10 to a mother board (shown in FIGS. 2 and 3) and which is described more fully in U.S. Pat. No. 4,186,982 "Contact With Split Portion For Engagement With Substrate" issued Feb. 5, 1980 to Cobaugh et al.

Figure 2:
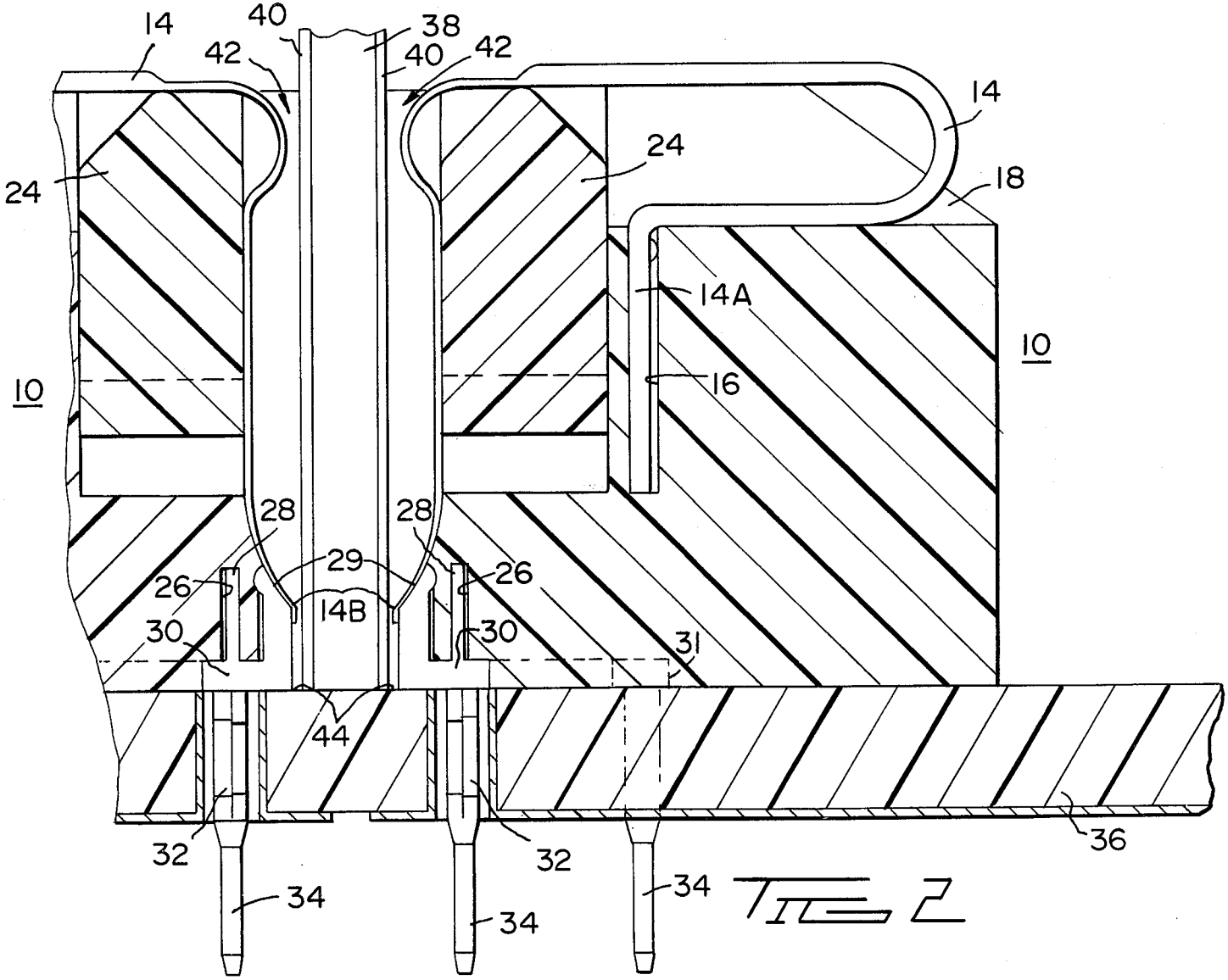
FIG. 2 is a side sectional view of the connector assembly shown in FIG. 1 with an additional connector assembly adjacent thereto both of which are in the open contact position.
Figure 7:
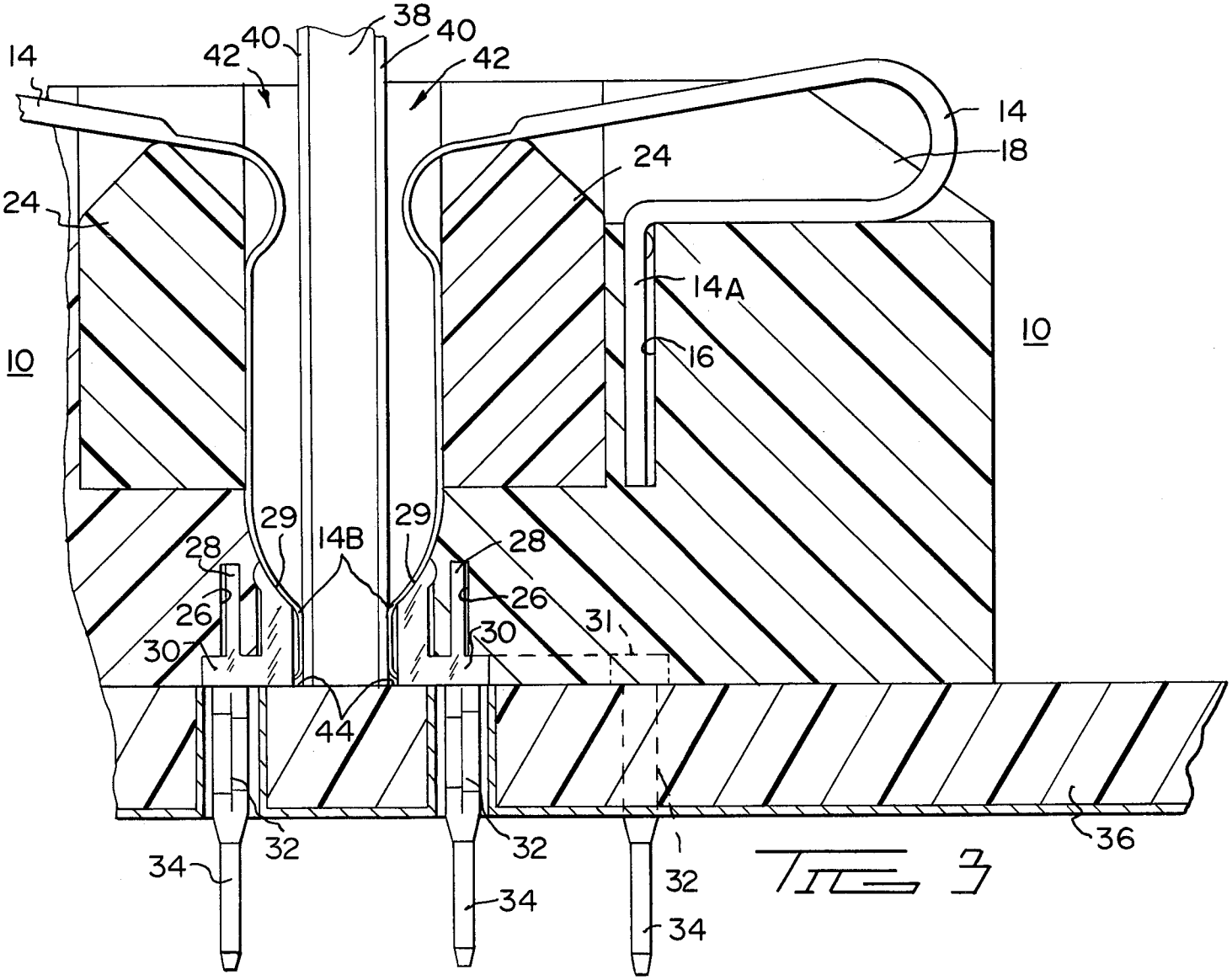

Referring now to FIG. 2, a side sectional view of the connector assembly 10 is shown with the contacts 14 in the open position. It can be readily be seen that two connector asemblies 10, 10 are mounted on a mother circuit board 36 facing each other so as to form a daughter board receiving channel 42. A daughter circuit board 38 having conductive strips 40 disposed thereon is inserted into the daughter board receiving channel 42 onto the daughter board receiving ledge 44. It is to be understood that although a side-by-side relationship of the connector assemblies is shown with corresponding conductive strips 40 on each side of the daughter circuit board 38, single assemblies 10 or a daughter circuit board 38 having a conductive strip 40 on only one side may be utilized. It can also be readily seen that the cam 24 when moved laterally is also due to the cam serrations 22 (shown in FIG. 1) urged vertically upwards and impinges upon the contact 14. This movement of the cam 24 and therefore vertical movement of the contact 14 will cause the contact tip **14*b* to slide along the contact area 29, while remaining in electrical contact with the conductive posts 34 and move inwardly and upwardly away from the conductive strips 40 contained on the daughter circuit board 38. This therefore completely disengages the daughter circuit board 38 so as to be readily insertable or extractable with zero force on the contact tips 14*b* or the conductive strips 40. It is to be understood that in the preferred embodiment of the present invention the contacts 14 are made of an electrically conductive material which is stamped out of a continuous strip of metal and formed into the present shape. This therefore allows the use of a test point at any point along the contact 14 or more preferably the uppermost portion of the contact 14 at the top of the connector assembly 10**.

Referring now to FIG. 3, a view similar to that shown in FIG. 2 is illustrated with the contacts in the closed position. Here it can be seen that the cam 24 is fully mated with the serrations (shown in FIG. 1) thereby allowing the contact 14 to slide vertically downward from the open position (as shown in FIG. 1). This downward movement allows the contact tip **14*b* to slide along the contact area 29 maintaining continuous electrical contact therewith and is forced to come in contact with the conductive strips 40 contained on the daughter circuit board 38. When the contact tip 14*b* comes in contact with the conductive strips 40 it is forced, in a curvilinear motion, to continue along the conductive strips 40 in the daughter board receiving channels 42. This thereby causes a wiping action on the conductive strips 40 as well as forming a relatively large contact area between the conductive tip 14*b* and the conductive strips 40 and provides good electrical contact therebetween. Additionally, a strong structural or mechanical force is exerted so as to relatively rigidly hold the daughter circuit board 38 in the daughter board receiving channel 42. A wiping action is also formed between the contact tip 14*b* and the contact area 29. Therefore, an extremely short portion of the contact 14 is used to provide electrical communication between the conductive strips 40 and the contact area 29 and thence the conductive posts 34**.

Figure 4:
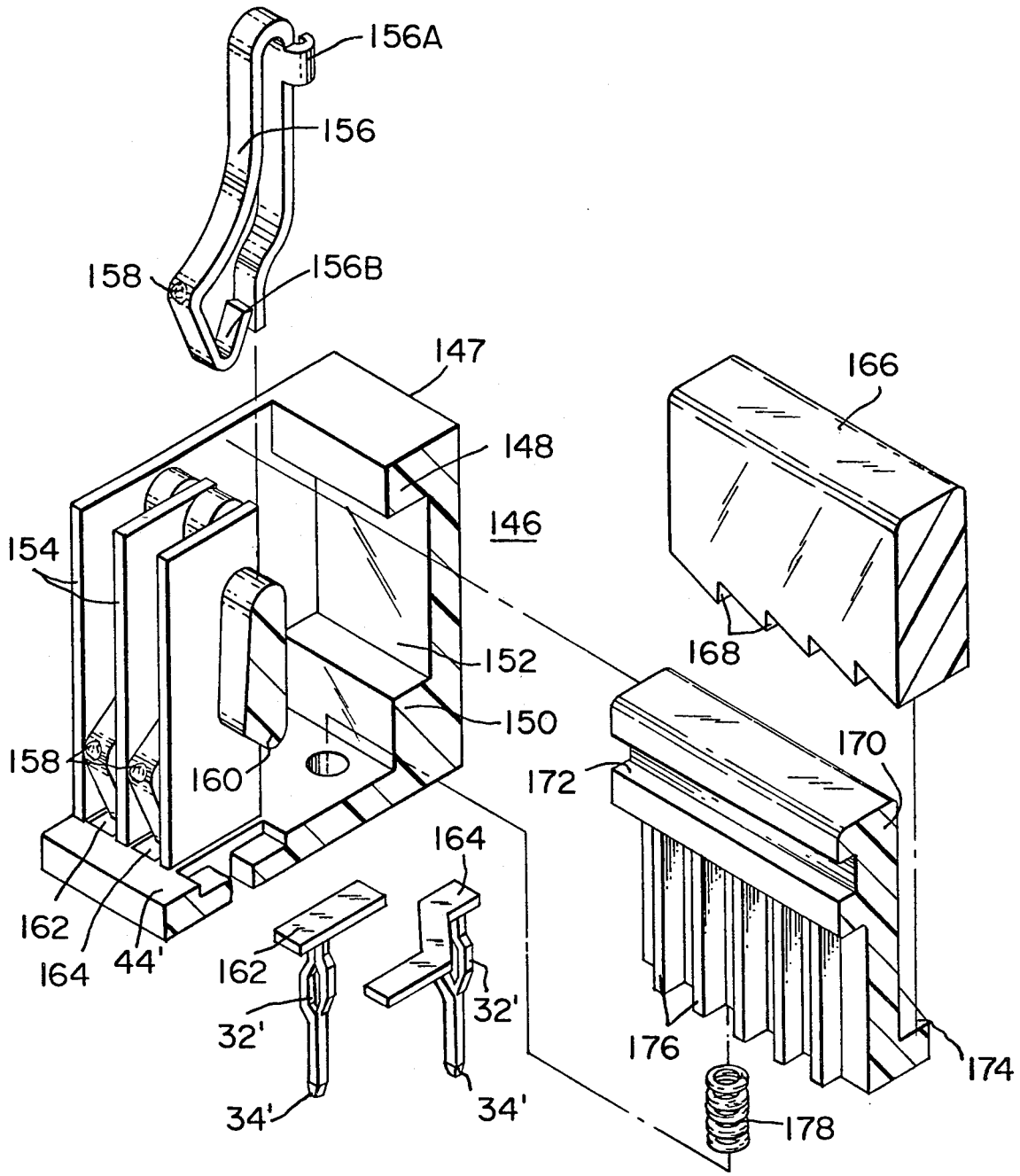
FIG. 4 is an enlarged perspective view of an electrical connector assembly which is an alternate embodiment of the present invention.

Referring now to FIG. 4, an alternate embodiment of the present invention is shown. It is to be remembered that components similar in structural operation to previously described components will be identified by the previously assigned numeral with the addition of a prime (').

The connector assembly 146 is comprised of a housing 147 having a housing upper portion 148 and a housing lower portion 150 with a housing recess 152 therebetween. A contact configuration 156 is shown which has a guide **156*a* and a contact lower portion 156*b*. Disposed on the contact configuration 156 is a nub 158. The contact 156 is disposed in the housing 147 with contact barriers 154 between each contact 156 which electrically isolate the contacts 156 as well as provide structural integrity to the connector assembly 146 and prevent unwanted deformation of the contact 156. Here a daughter board receiving ledge 44' is part of the housing 147. Again conductive posts 34' having split portions 32' and which protrude through a mother board (not shown) are disposed in the housing 147 in a zig-zag fashion thereby providing greater spacing between the conductive posts 34'. Accordingly, a conductive surface 162 is interspaced with a zig-zag conductive surface 164**.

Figure 5:
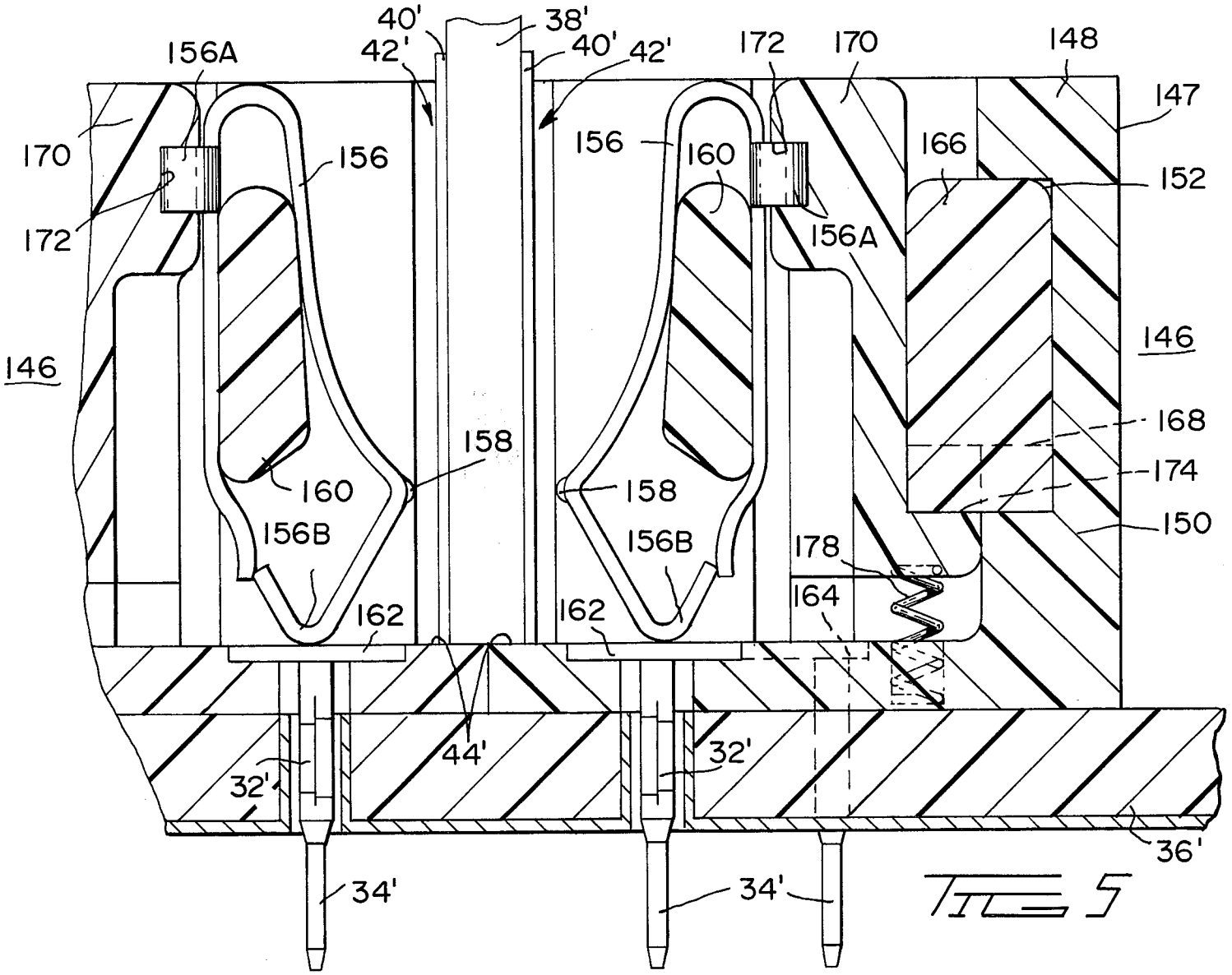
FIG. 5 is a side sectional view of the alternate embodiment of the present invention as shown in FIG. 4 with the contacts in the open position.
Figure 6:
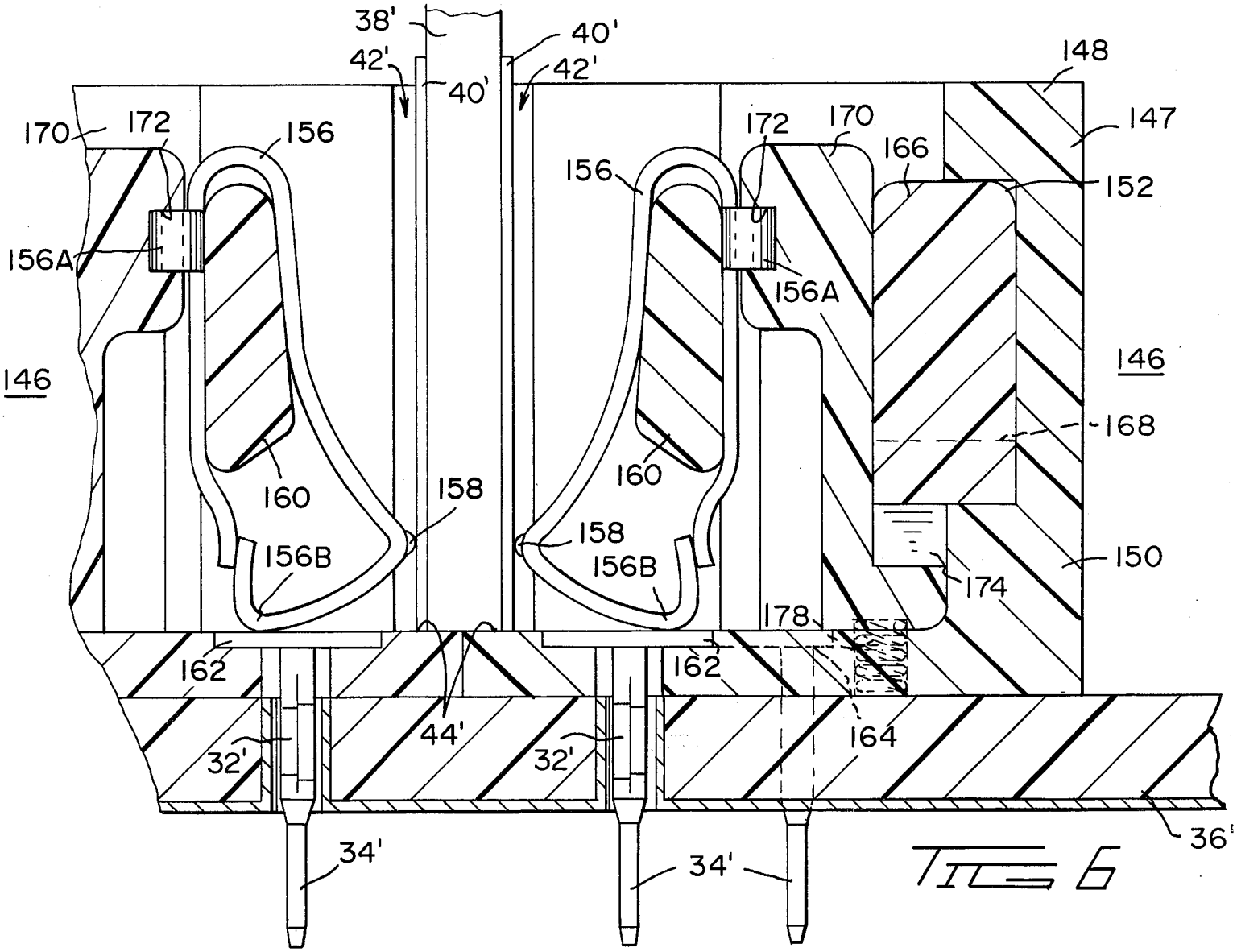
FIG. 6 is a side sectional view similar to that shown in FIG. 5 with the contacts in the closed position.

A cam 166 is utilized which has a cam serration 168. The cam serration 168 mates with the slot serrations 174 of the slide 170. The cam 166 is disposed in the housing recess 152 (as shown in FIGS. 5 and 6) adjacent to the slides 170. The slide 170 has a contact guide slot 172 for receiving the contact guide **156*a* (as shown in FIGS. 5 and 6). Slide partitions 176 are disposed on the slide 170 and are used to provide electrical isolation between contacts 156 (shown more clearly in FIGS. 5 and 6). A positioning tab 160 is used to hold the contact 156 in the housing 147 (as shown in FIGS. 5 and 6**).

Referring now to FIG. 5 there is shown a side cross-sectional view of side-by-side connector assemblies 146 with the contact 156 in the open position. Here it can be seen that slide springs 178 maintain the slide 170 in the uppermost portion of the housing 147. Also the contact 156 is disposed around the positioning tab 160 thereby holding the contact 156 in the housing 147 as well as helping to define the permissible range of movement of the contact 156. Shown also is the nub 158 clearly disengaged from the conductive strips 40' which are contained on the daughter circuit board 38'. Therefore, the daughter circuit board 38' can be readily inserted or extracted from the daughter board receiving channel 42' and the daughter board receiving ledge 44'. Also shown is the lower portion **156*b* of the contact 156 in contact with the conductive surfaces 162 or the zig-zag conductive surface 164**.

Referring now to FIG. 6, there is shown a view similar to that in FIG. 5 with the contact 156 in the closed position. During closing of the contacts 156, and therefore engagement with the conductive strips 40', the cam 166 is laterally moved (as shown in FIG. 4), so as to cause the cam serrations 168 engage with the slide serrations 174. This therefore, causes the slide 170 to be urged downwards towards the bottom of the housing 147 and the mother circuit board 36'. Since the contact guide **156*a* is disposed in the contact guide slot 172, movement of the slide 170 downward will cause the contact 156 to also slide or be urged downwards. This movement of the contact 156 will cause the lower portion 156*b* to slide along the surface of the conductive surface 162 or the zig-zag conductive surface 164 in a wiping motion and will be bent slightly upwards in the manner shown. This will therefore cause the portion of the contact configuration which is facing the daughter circuit board 38' to curvilinearly flex outward with the nub 158 similarly moving outward and upward thereby forming a wiping action on the conductive strips 40'. That portion of the contact 56 which is adjacent to the slide 170 is also caused to resiliently flex in the curvilinear motion shown. This therefore as mentioned earlier causes a wiping action between the nub 158 and the conductive strips 40' as well as the lower portion 156*b* and the conductive surfaces 162, 164. Additionally, forces are again created which relatively fixedly secure the daughter circuit board 38' in the daughter board receiving channel 42'**.

In a reverse fashion opening of the contacts by lateral motion of the cam 166 allows the slide 170 to be urged upwards by the slide spring 178. This causes the contact 156 to move vertically upward thereby allowing the lower portion **156*b* to move outwardly towards the daughter circuit board 38' with the nub 158 moving inwardly and upwardly to the position shown in FIG. 5. Therefore, a very short contact length is established between the conductive strips 40' and the conductive posts 34'** which again minimize capacitive, inductive and propagation delay problems.

It is to be understood that many variations of the present invention may be utilized without departing from the spirit or scope of the present invention. For example, circuit boards may include any board, card or substrate in which electrical circuit conductors are secured by printing plating, or other suitable process. Additionally, the contacts may be comprised of any suitable metals such as gold or may be entirely comprised of, for example, plastic with a suitable conductive coating contained thereon. Additionally, the nub may be formed from merely protruding a piece from the contact itself or may be an additional piece of electrically conductive material added thereto or may be omitted totally. Further, the springs may be formed of any suitable resilient material which will urge the slide vertically upward. Additionally, a single connector assembly may also be utilized with a daughter circuit board having only the conductive strips contained on one side. Also, other camming schemes such as, for example, rotary camming which would cause suitable movement of the contacts may be utilized. Further, different contact posts suitable for insertion with a mother board may be utilized as well as different materials other than plastic for the housing thereby accommodating thermal expansion which may be anticipated for a particular usage. Different zig-zag or offset configurations may also be utilized which may or may not change the distance between the conductive posts. Additionally, multiple assemblies may be utilized adjacent to each other thereby providing a ganging or serial combination.

Therefore, in addition to the above enumerated advantages, the disclosed invention produces a circuit board edge connector which is compact, providing modular growth capabilities, accommodating thermal expansion as well as various circuit board arrangement constraints and providing very short contact length so as to minimize conductive capacitive or propagation delay effects which may be of concern.

What is claimed is:

1. A miniature circuit board edge connector, comprising:

an insulative housing;

conductive posts projecting from said housing having conductive areas adjacent the interior of said housing;

circuit boards having conductive strips contained thereon said circuit board being receivable by said housing;

electrically conductive spring contact means disposed in said housing, and being characterized by a first inverted generally U-shaped portion and having at the other end a second portion forming an upright generally U-shape wherein the lower part of said second portion is in slidable electrical communication with said conductive areas further characterized is that the point wherein said U-shaped portions are joined is relatively deformable so as to come into contact with said conductive strips thereby establishing a circuit path along the upright U-shaped portion between the conductive strips and conductive posts; and camming means disposed in said housing and engaging said first U-shaped portion wherein said camming means is utilized to urge said first portion downward thereby establishing said circuit path.

2. A device according to claim 1 wherein an electrically conductive protrusion is disposed on said electrically conductive spring contact means which comes into electrical contact with said conductive strips.

3. A miniature circuit board edge connector, comprising:

an insulative housing;

conductive posts projecting from said housing having contact areas adjacent the interior of said housing;

circuit board having conductive strips contained thereon said circuit board being receivable by said housing;

electrically conductive spring contact means disposed in said housing characterized by a first generally L-shaped portion having one end fixedly disposed in said housing, a generally U-shaped member having one end joined at the remaining end of said first L-shaped portion and further having a second generally L-shaped portion at the remaining end of the U-shaped member wherein said first and said second L-shaped portions are generally parallel to each other, said second L-shaped portion being in slidable electrical communication with said contact areas and further being relatively deformable so as to be able to move downwards and outwards into electrical contact with said conductive strips thereby establishing a circuit path between said conductive strips and said contact areas; and camming means disposed in said housing and engaging said contact so as to permit said second L-shaped portion of said contact to move downwards thereby establishing said circuit path.

4. A device according to claims 1 or 3 wherein a plurality of said circuit board edge connectors are disposed in side-by-side relationship.

5. A device according to claim 4 wherein conductive strips are disposed on each side of said circuit board for coming into electrical contact with each of said circuit board edge connectors.

6. A device according to claim 1 or 3 wherein said housing has a series of compartments, each compartment having a conductive post and further having removably assembled therein said spring contact means wherein said cam means intersect said compartments so as to allow said cam means to cause an associated spring contact to move downward and outward thereby coming in contact with said conductive strips.

7. A device according to claim 1 or 3 wherein said spring contact means is comprised of an electrically insulative material having a conductive material deposited thereon.

8. A device according to claim 1 or 3 wherein said housing comprises a plurality of housing sections mounted on a second circuit board so as to move in compliant response to thermal expansion or contraction of said second circuit board.

* * * * *